United States Patent [19]

Heiser et al.

[11] 4,150,690

[45] Apr. 24, 1979

[54] HYDRAULIC CONTROL ARRANGEMENT FOR AT LEAST TWO HYDRAULIC CONSUMERS

[75] Inventors: Joachim Heiser, Stuttgart; Wolfgang Bernhardt, Korntal, both of Fed. Rep. of Germany

[73] Assignee: Robert Bosch GmbH, Stuttgart, Fed. Rep. of Germany

[21] Appl. No.: 851,755

[22] Filed: Nov. 15, 1977

[30] Foreign Application Priority Data

Jan. 15, 1977 [DE] Fed. Rep. of Germany ..... 2701509

[51] Int. Cl.[2] ..... F15B 13/08

[52] U.S. Cl. ..... 137/596.13; 91/446

[58] Field of Search ..... 137/596.12, 596.13; 91/446, 451

[56] References Cited

U.S. PATENT DOCUMENTS 3,722,543 3/1973 Tennis ..... 137/596.13 X 3,989,062 11/1976 Tennis ..... 137/596.13

*Primary Examiner*—Gerald A. Michalsky

*Attorney, Agent, or Firm*—Michael J. Striker

[57] ABSTRACT

A hydraulic control arrangement for at least two hydraulic consumers, comprises two pressure compensated multiple position valves, respectively coordinated with the two consumers, and each including a pressure compensating control member which controls a control conduit coordinated with a reversing or unloading valve, which, depending on its position and those of the multiple position valves control flow of pressure fluid from a pump over the multiple position valves to the respective consumer or to a return conduit. This will assure that even during parallel operation of both consumers, the output of the pump will be adjusted to the consumer load in such a manner that energy losses are substantially avoided and control of the two consumers independent from each other is assured.

6 Claims, 3 Drawing Figures

HYDRAULIC CONTROL ARRANGEMENT FOR AT LEAST TWO HYDRAULIC CONSUMERS

BACKGROUND OF THE INVENTION

The present invention relates to control arrangements for at least two hydraulic consumers for each of which a pressure compensated multiple position valve is provided and in which each multiple position valve has at least two control members for controlling the direction of movement of the consumer coordinated therewith, for providing a pressure compensation, and for throttling the flow of pressure fluid to the respective consumer. The arrangement includes further a reversing or unloading valve connected in parallel to the two multiple position valves for controlling flow of pressure fluid from a source of such pressure fluid either directly to a return conduit or over the multiple position valves to the respective consumer. The reversing valve, in turn, is controlled by the control members of the two multiposition valves which produce the pressure compensation.

Such a control arrangement is already known in the art as for instance disclosed in the U.S. Pat. No. 3,722,543, in which a first control member of each multiple position valve has the function of controlling the direction of movement of the consumer coordinated therewith and throttling flow of pressure medium thereto and a second control member, connected in series with the first control member, and producing the pressure compensation. In this construction the second control members are all connected in series to a pressure fluid inlet channel and control thus further flow of fluid to the following first control member. This known control arrangement is relatively complicated. In addition, this known control arrangement leads to energy losses and increases also the danger of mutually influencing the two consumers during parallel operation. In this known control arrangement, it is further necessary that a maximum operating pressure is transmitted, over throttles and one-way valves in a branched control conduit, to the unloading valve, which further complicates the control arrangement.

SUMMARY OF THE INVENTION

It is an object of the present invention to provide a hydraulic control arrangement of the aforementioned kind, which avoids the disadvantages of such control arrangements known in the art.

It is a further object of the present invention to provide a hydraulic control arrangement which is considerably simpler than such control arrangements known in the art.

It is an additional object of the present invention to provide a control arrangement which may be operated with the smallest energy losses and in which mutual influence during parallel operation of the consumers is substantially avoided.

With these and other objects in view, which will become apparent as the description proceeds, the hydraulic control arrangement according to the present invention for controlling at least two hydraulic consumers mainly comprises two pressure compensated multiple position valve means respectively coordinated with the consumers, in which each of the valve means includes two control members, a first one for selecting the direction of movement of the consumer coordinated therewith and for throttling flow of pressure medium thereto and a second spring biased control member for compensating a pressure difference produced in the first control member during throttling of the flow of pressure medium. The arrangement includes further an unloading valve connected in parallel to the two valve means to an inlet conduit into which pressure fluid is fed from a source of pressure medium, for instance a pump, and the unloading valve is movable between an open position feeding the fluid medium from the inlet conduit directly to a return conduit and a plurality of second position throttling such flow to an increasing extent. A first control conduit connects the inlet conduit with the unloading valve and the two valve means and leads from the latter to the return conduit. A throttle is provided in the first control conduit and control means connected to each of the second control members control flow of fluid passing through the first control conduit. Second and third control conduits are further provided for each of the valve means for transmitting the pressure difference produced by the first control member of each valve means onto the respective second control member of the respective valve means. The second control members of the two valve means are connected in parallel with the inlet conduit.

Each of the second control members is constructed as a slide valve and the aforementioned control means are constituted by a control edge on each of the slide valves and controlling flow of pressure fluid through the first control conduit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
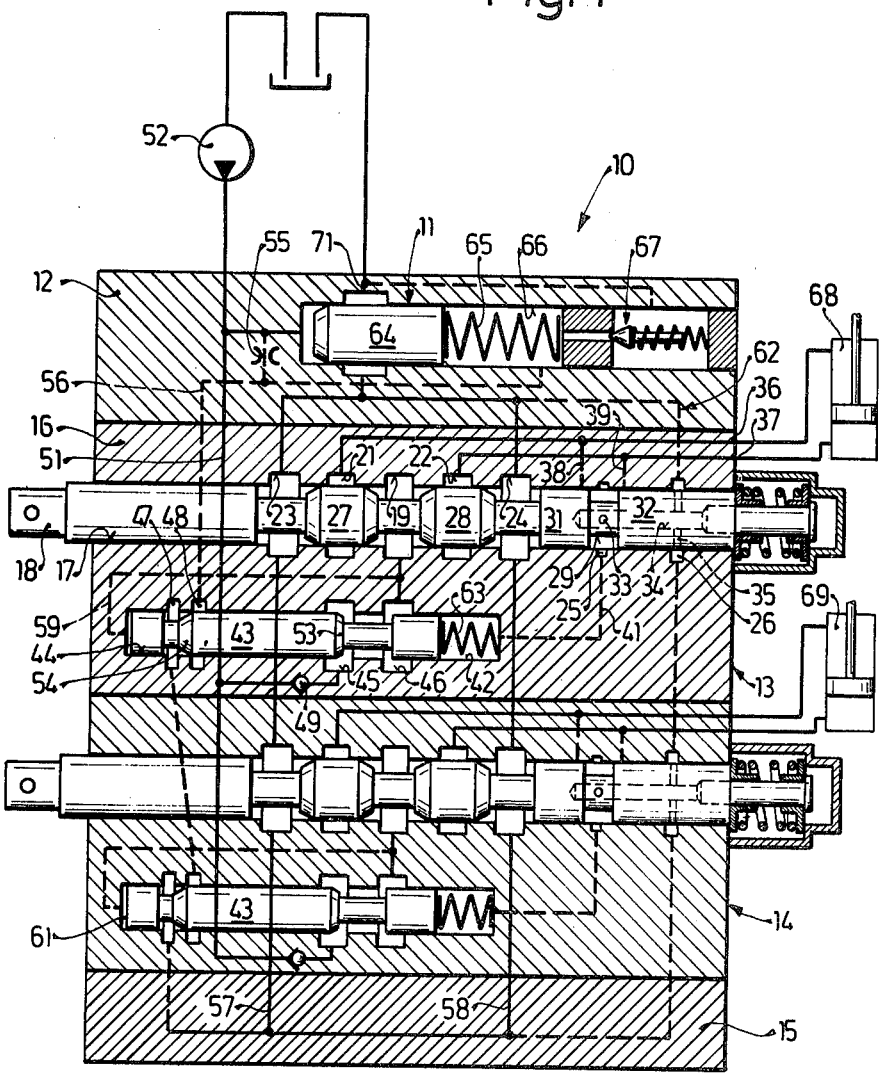
FIG. 1 is a longitudinal cross section through a control arrangement according to the present invention.

Referring now to the drawing, and more specifically to FIG. 1 of the same, it will be seen that the control arrangement 10 according to the present invention may comprise a connecting plate 12, housing a reversing or unloading valve 11, a first pressure compensated multiple position valve 13 and a second pressure compensated multiple position valve 14, as well as an end plate 15. The multiple position valves 13 and 14 are constructed in exactly the same manner and in the following only the first multiple position valve 13 will therefore be described. The multiple position valve 13 has a housing 16 provided with a longitudinal bore 17 therethrough in which a first control member or valve spool 18 is arranged. Around the bore 17 there are provided an inlet chamber 19, two consumer chambers 21 and 22, two return chambers 23 and 24, a first annular control groove 25 as well as a second annular control grove 26. The control member 18 is provided with two piston sections 27, 28 for control of the connection between the chambers 19–24, as well as with an annular groove 29 between a third and fourth piston section 31 and 32. In the illustrated neutral position of the control member 19, the annular groove 29 is connected over the bores 33, 34 and 35 in the control member 18 with the second groove 26. The third and fourth piston sections 31 and 32 block at the same time control channels 38 and 39 which are connected with consumer channels 36 and 37 leading to the consumer 68. A control channel 41 leads from the first control groove 25 into a spring chamber 42, arranged at the end of a bore 44 in the housing 16, in which a second control member 43 is reciprocably arranged. The longitudinal bore 44 is provided with an inlet chamber 45 and an outlet chamber 46, as well as with a first annular channel 47 and a second annular channel 48. The inlet chamber 45 of the second bore 44 is connected by means of an inlet channel 51, in which a one-way valve 49 is arranged, with a source of pressure fluid, here shown as a pump 52. The outlet chamber 46 around the bore 44 is connected with the inlet chamber 19 provided about the bore 17. The second control member or valve spool 43 has a first control edge 53 cooperating with the inlet chamber 45, as well as a second control edge 54 coordinated with the annular channels 47 and 48.

A first control conduit 56, in which a throttle 55 is arranged, is connected to the inlet channel 51 and branches off, on the one hand, to the unloading valve 11 and, on the other hand, over the annular channels 48 and 47 provided in both bores 44 to return channels 57 and 58. A second control conduit 59 connects the outlet chamber 46 in the bore 44 with a pressure chamber 61 arranged at the end of the bore 44 opposite the spring chamber 42. A third control conduit is formed by the control channels 38, 39, 41, the bores 33, 34, 35 and the control grooves 25, and 26 to assure, on the one hand, impingement of the spring chamber 42 with the load pressure in a working position of the first control member 18 and, on the other hand, the release of pressure fluid from the spring chamber 42 to the return channel 58 in the shown neutral position of the first control member. The second control member 43 is constructed in such a manner that it will be pressed, in the absence of pressure fluid, by a spring 63 in the spring chamber 42 to a starting position, as shown in FIG. 1, in which its first control edge 53 fully opens the connection between the inlet chamber 45 and the outlet chamber 46, whereas its second control edge 54 blocks passage of fluid through the first control conduit 56. The control member 43 is movable against the force of the spring 63 to a plurality of intermediate-positions in which it throttles more or less or completely blocks the first mentioned connection, whereas the second mentioned connection is correspondingly opened.

Figure 2:
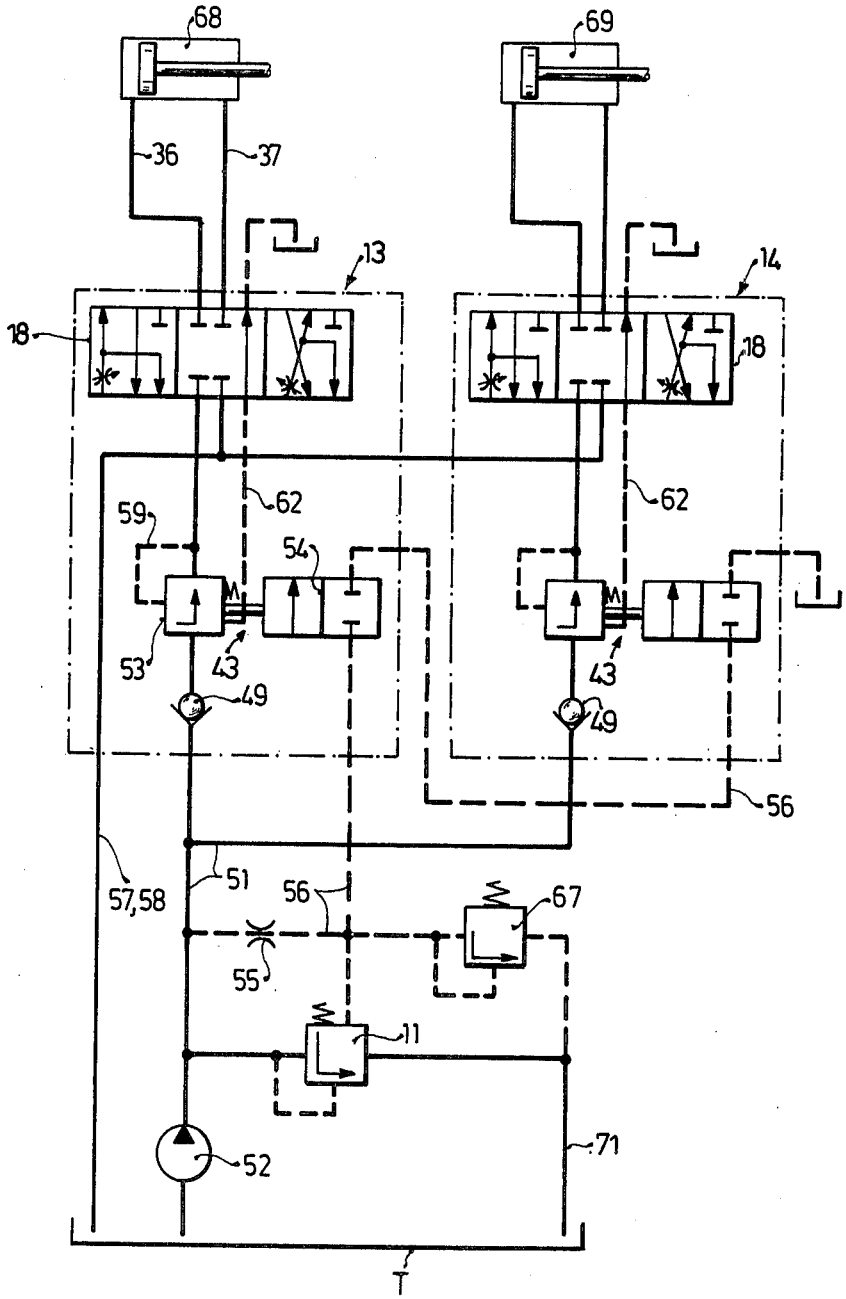
FIG. 2 is a circuit diagram of the control arrangement shown in FIG. 1.

As clearly shown in FIG. 2 the two multiple position valves 13 and 14 are connected in parallel to the inlet channel 51 and additionally connected in parallel to the unloading valve 11. The second control members 43 are connected in series in the first control conduit 56 and form respectively therein two-way valves. The unloading valve 11 has a control member 64 movable longitudinally in a bore provided in the connecting plate 12. A spring 65 arranged in a chamber 66 of the bore biases the control member 64 towards the left, as viewed in FIG. 1. An overpressure valve 67 communicates with the chamber 66 for limiting the fluid pressure therein. The first control conduit 56 communicates with the aforementioned chamber 66. The first multiple position valve 13 is connected by means of the consumer conduits 36 and 37 to a first consumer 68 and controls therefore the operation of the latter, whereas the second multiple position valve 14 is connected over the similar conduits to a second consumer 69 to control the operation of the same.

The above described arrangement 10 operates as follows:

It is assumed that the first control members 18 of both valves 13 and 14 are in their shown neutral position. If now the pump 52 feeds pressure fluid into the inlet channel 51, then the largest portion of this stream of pressure fluid flows substantially unthrottled over the unloading valve 11 directly to the return conduit 71 which leads to a tank T from which the pump 52 sucks pressure fluid into the inlet channel 51. Only a small partial stream of pressure fluid flows simultaneously from the inlet channel 51 over the throttle 55 and the first control conduit 56 to the return channel 57. This partial stream of pressure fluid is produced because the low pressure produced in the inlet channel 51, in the open position of the unloading valve 11, flows over the one-way valves 49, the first control edges 53 of the second control members 43 and the second control conduits 59 into the pressure chambers 61 and acts to move the second control members 43 against the force of the springs 63 so that the second control edges 54 permit throttled flow of fluid through the first control conduit 56. Thereby the spring chambers 42 are respectively released from pressure over the third control conduits 62 to the return conduit 71. The second control members 43 do not close the connections between their inlet chambers 45 and their outlet chambers 46, but only throttle slightly these connections by moving to intermediate positions in which the first control conduit is only throttled but not completely blocked. Therefore the pump 52 operates against a pressure which depends on the relative weak spring 65 of the unloading valve 11 and which is increased by a pressure which depends on the stronger springs 63 of the second control members 43.

If now, only the valve 13 is moved from its neutral position to an operating position in which pressure fluid moves to the hydraulic consumer 68 cooperating therewith, then the spring chamber 42 of the second control member 43 of the valve means 13 is impinged by the respective low pressure and the second control member 43 throttles, respectively blocks the first control conduit 56. The unloading valve 11 closes and the pump 52 builds up pressure so that the pressure medium flows over the second control member 43 and the first control member 18 of the valve 13 to the consumer 68. The thereby occurring pressure difference at the first control member 18 of the valve 13 acts over the second and the third control conduit 59 and 41 onto the second control member 43 of the first valve means 13 so that this second control member 43 throttles by means of its control edge 53 the flow of pressure medium in such a manner that in the respective position of the first control member 18 this pressure difference is maintained constant in the inlet channel 51 and independent of load influences or pressure variations, to produce thereby a pressure compensated control of the consumer 68. In addition, it should be noted that the control movements of the second control member 43 influence also flow of pressure fluid through the first control conduit 56. For instance if the pressure difference at the first control member 18 of the valve means 13 increases, the first control edge 53 of the corresponding control member 43 will throttle the fluid flow coordinated therewith. During the movement of the second control member 43 towards the right, as viewed in FIG. 1, the throttling in the first control conduit 56 is decreased by the second control edge 54. This will lead to a smaller closing force acting on the member 64 of the unloading valve 11 so that the pressure in the inlet channel 51 decreases. The second control member 43 can now move again towards its starting position shown in FIG. 1, whereby the flow losses at the second control member are held as small as possible. On the other hand, a lowering of the pressure difference at the first control member leads to an increasing opening up of the flow between the chambers 45 and 46, controlled by the first control edge 53 and to a simultaneous increased throttling of the first control conduit 56, which leads to a pressure increase by the unloading valve 11. This means, that each pressure difference change is firstly compensated by a reaction of the second control member 43, but that simultaneously the pressure produced by the pump 52 is adjusted to the changed operating conditions by the unloading valve 11, so that the second control member 43 can again return to its starting position. The fluid flow losses are in this way maintained at a low value. If the second multiple position valve 14 is not actuated, but left in its neutral position as shown in FIG. 1, then the spring chamber 42 of the second valve 14 is relieved of pressure over the third control conduit 62 to the return conduit 71, whereas the acting pressure in the inlet conduit 51 moves the second control member 43 of the second valve 14 towards the right, as viewed in FIG. 1, in such a manner that the first control conduit 56 is not blocked and the operating movements in the first valve 13 are not disturbed.

If both multiple position valves 13 and 14 are simultaneously operated, then both hydraulic consumers 68 and 69 may be controlled substantially independently from each other in a load compensated manner. Thereby the maximal load pressure prevailing at any time is indirectly measured and selected by the positions of the second control members 43 and used for control of the pressure of the fluid delivered by the pump 52. The pressure produced by the pump 52 is thus adjusted only slightly higher than the maximum load pressure prevailing at any time plus the predetermined pressure difference. If the amount of pressure medium flowing to a hydraulic consumer with a low load pressure is greater than the amount of pressure medium pumped by the pump 52, then the hydraulic consumer with the higher load pressure is protected by the respective one-way valve 49.

Figure 3:
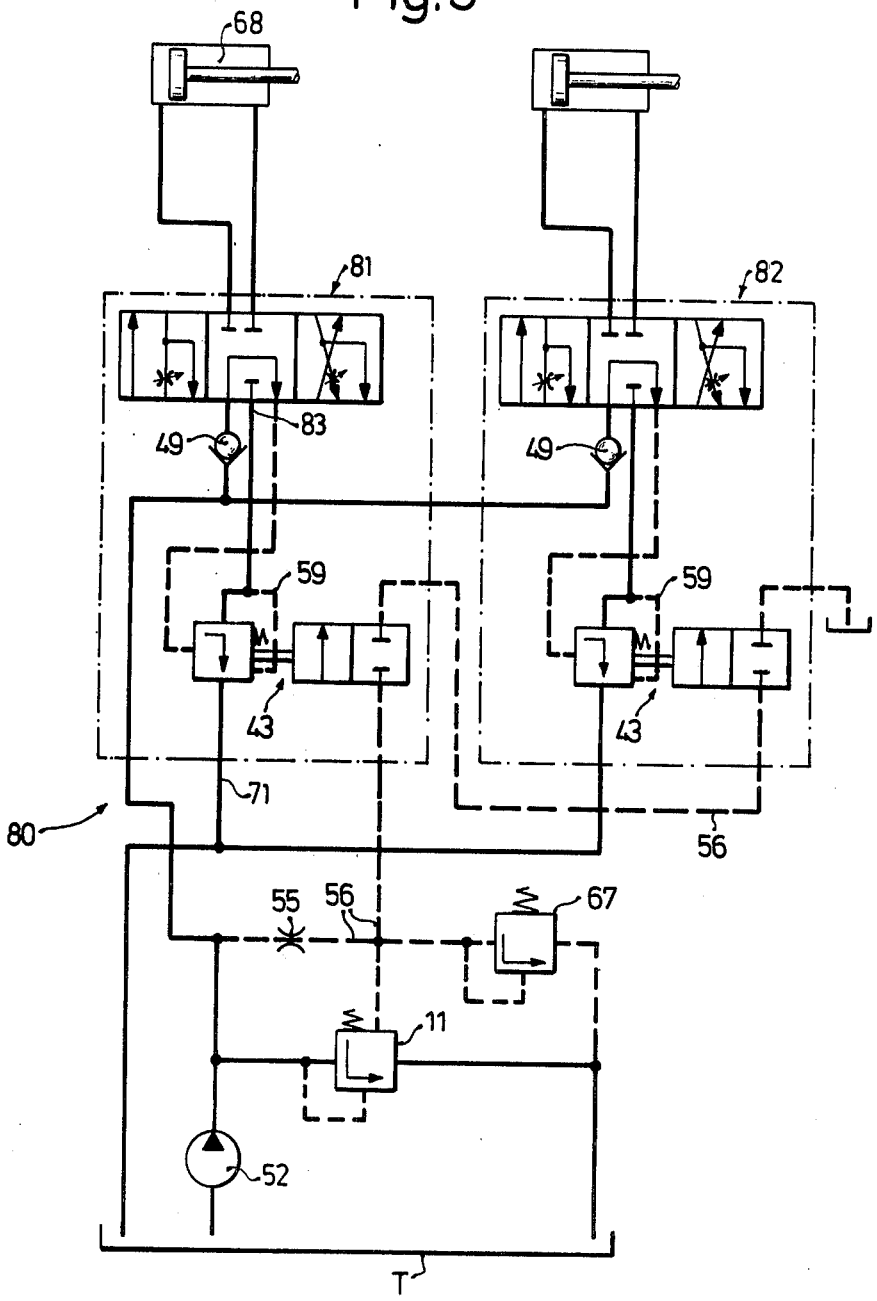
FIG. 3 is a circuit diagram of a second embodiment of the control arrangement.

FIG. 3 shows a second control arrangement 80 which differs from the above discussed control arrangement illustrated in FIGS. 1 and 2 first of all that the multiple position valves 81 and 82 are, as will be evident from a comparison of FIGS. 2 and 3, differently constructed and in that the second control members 43 are respectively arranged between a return flow connection 83 of the first control members 18 and the return conduit 71.

The control arrangement 80 shown in FIG. 3 operates in principle in the same manner as the control arrangement 10. Arranging each of the second control members 43 in the return conduit 71 downstream of the respective first control members will assure that a proper regulation of the consumers 68 and 69 will also occur at a pulling load acting on the consumers.

It will be understood that each of the elements described above, or two or more together, may also find a useful application in other types of hydraulic control arrangements for at least two hydraulic consumers, differing from the types described above.

While the invention has been illustrated and described as embodied in a hydraulic control arrangement for at least two consumers, it is not intended to be limited to the details shown, since various modifications and structural changes may be made without departing in any way from the spirit of the present invention.

Thus, for instance the fluid flow forces acting on the second control members 43 can be used to support the forces of the springs 63, so that the circulating pressure can still be further lowered without reducing the magnitude of the predetermined pressure difference. The second control edge 54 may also be arranged on a separate valve member which may be coupled in any known manner with the second control member.

A further advantage of the control arrangement 10 consists in that parallel to the main pressure medium stream to the consumer no alternating control flow stream will lead parallel to the consumer or from the same to the unloading valve 11 which controls the pressure in the inlet conduit. In addition, the control arrangement 10 has the advantage that it produces an amplification action. Since the amount of fluid medium for controlling the member 64 of the unloading valve is not taken from the actual load circuit, and therefore not influences the latter, this amount can be made considerably greater than in control arrangements according to the prior art. This will assure a quick response of the unloading valve 11 which regulates the pressure in the inlet conduit 51.

We claim:

1. A hydraulic control arrangement for at least two hydraulic consumers, comprising two pressure compensated multiple position valve means respectively coordinated with said consumers, each of said valve means including two control members, a first one for controlling the direction of movement of the consumer coordinated therewith and for throttling flow of pressure medium thereto and a second spring biased control member for compensating a pressure difference produced by said first control member during throttling of the flow of said pressure medium therethrough; a source of pressure medium including a pump feeding pressure medium from a tank into an inlet conduit; a return conduit communicating with said tank; an unloading valve connected in parallel to said two valve means to said inlet conduit and movable between an open position permitting flow of the fluid medium from said inlet conduit directly to said return conduit and a plurality of second positions throttling such flow to an increasing extent; a first control conduit connecting said inlet conduit with said unloading valve and the two valve means and leading from the latter to said return conduit; a throttle in said first control conduit; control means connected to each of said second control members for controlling flow of fluid passing through said first control conduit; and second and third control conduits for each of said valve means for transmitting a pressure difference produced by the first control member of each valve means onto the respective second control member of the respective valve means, said second control members of said two valve means being connected in parallel to said inlet conduit.

2. A hydraulic control arrangement as defined in claim 1, wherein each of said second control members is constructed as a slide valve on which said control means is provided.

3. A hydraulic control arrangement as defined in claim 2, wherein each of said second control members is connected to said inlet conduit upstream of the respective first control member.

4. A hydraulic control arrangement as defined in claim 2, wherein each of said second control members is connected to said return conduit downstream of the respective first control member.

5. A hydraulic control arrangement as defined in claim 2, and including a valve housing formed with two bores in which the slide valves forming said second control members of said two valve means are respectively movable in longitudinal direction, each of said bores being formed with two adjacent annular channels, said first control conduit having a first section connecting said inlet conduit with one of the annular channels in the bore of one of said slide valves, a second section connecting the other annular channel in the bore of the one slide valve with one annular channel in the bore of the other slide valve and the other annular channel in the bore of the other slide valve with a return channel connected with said return conduit, said control means being constituted by a control edge on each of said slide valves and arranged for controlling flow between said annular channels of each slide valve.

6. A hydraulic control arrangement as defined in claim 5, wherein each of said bores is further provided with an annular inlet chamber communicating with said inlet conduit and an annular outlet chamber adapted to be connected by means of the first control member to the consumer cooperating therewith, each of said second control members being spring biased to a first position in which the pressure medium may flow from said inlet chamber to said outlet chamber while flow between said annular channels is prevented and a plurality of second positions in which flow from said inlet chamber to said outlet chamber is throttled to an increasing extent while the connection between said annular channels is opened to an increasing extent as said slide valve moves away from said first position.

* * * * *